US008602117B2

(12) United States Patent
Janik

(10) Patent No.: US 8,602,117 B2
(45) Date of Patent: Dec. 10, 2013

(54) SYSTEM AND METHOD FOR SUPPLYING SEA WATER DURING FIRE FIGHTING OPERATIONS ON A NAVAL VESSEL

(75) Inventor: John Janik, Humble, TX (US)

(73) Assignee: Electronic Power Design, Houston, TX (US)

( * ) Notice: Subject to any disclaimer, the term of this patent is extended or adjusted under 35 U.S.C. 154(b) by 628 days.

(21) Appl. No.: 12/291,579

(22) Filed: Nov. 12, 2008

(65) Prior Publication Data

US 2010/0078183 A1 Apr. 1, 2010

Related U.S. Application Data

(60) Provisional application No. 61/100,993, filed on Sep. 29, 2008.

(51) Int. Cl.
*A62C 35/00* (2006.01)

(52) U.S. Cl.
USPC ..... 169/13; 169/54

(58) Field of Classification Search
USPC ..... 169/5, 13, 43, 54; 239/112, 113, 569; 440/88 R
See application file for complete search history.

(56) References Cited

U.S. PATENT DOCUMENTS

| | | | | |
|---|---|---|---|---|
| 3,984,302 | A * | 10/1976 | Freedman et al. | 204/274 |
| 4,140,146 | A | 2/1979 | Slanker | |
| 5,803,596 | A | 9/1998 | Stephens | |
| 6,645,024 | B1 | 11/2003 | Zumpano | |
| 6,672,919 | B1 | 1/2004 | Beson | |
| 2005/0072174 | A1 | 4/2005 | Beers | |
| 2008/0302317 | A1 | 12/2008 | Brown | |

* cited by examiner

*Primary Examiner* — Davis Hwu
(74) *Attorney, Agent, or Firm* — G. Michael Roebuck

(57) ABSTRACT

A method for pumping water on a naval vessel is disclosed, the method including but not limited to pumping fresh water from a fresh water reservoir into a fresh water flush tank; pumping salt water from a salt water reservoir into a a fire water reservoir during fire operations; controlling a valve in liquid communication to alternately connect the fire water reservoir to the salt water reservoir to supply salt water to the fire water reservoir during fire operations and connecting the fire water reservoir to the fresh water flush to flush salt water from the fire water reservoir after fire water operations. A system is disclosed for practicing the method.

4 Claims, 3 Drawing Sheets

SYSTEM AND METHOD FOR SUPPLYING SEA WATER DURING FIRE FIGHTING OPERATIONS ON A NAVAL VESSEL

RELATED APPLICATIONS

This application claims the benefit of and priority to U.S. Application No. 61/100,993 filed Sep. 29, 2008; the full disclosure of with is hereby incorporated by reference herein in its entirety.

FIELD OF THE DISCLOSURE

The field of the present disclosure relates to water supply systems.

BACKGROUND OF THE DISCLOSURE

Naval vessels typically utilize sea water, which is plentiful to fight fires on board ship. On naval ships there is normally available an engine-driven-fire pump ready for use in case of a fire. The reliability of the fire pump for emergency use must be 100%. However, during normal conditions, the actual use of these fire pumps is for dewatering purposes. Accordingly, the typical navy fire pump is a centrifugal pump designed to be able to handle both fire fighting and dewatering operations. In some dewatering operations, the engine and fire pump must be taken down the hold, thereby requiring, for safety, the provision of an engine exhaust hose which must be run a substantial distance, the exhaust hose serving to remove the engine-produced carbon monoxide from the hold. Also, in many cases it is necessary to lift the water a substantial distance and since centrifugal pumps are limited in how high they can lift water, special equipment, such as eductors, may have to be used in high lift applications.

DETAILED DESCRIPTION

Figure 1:
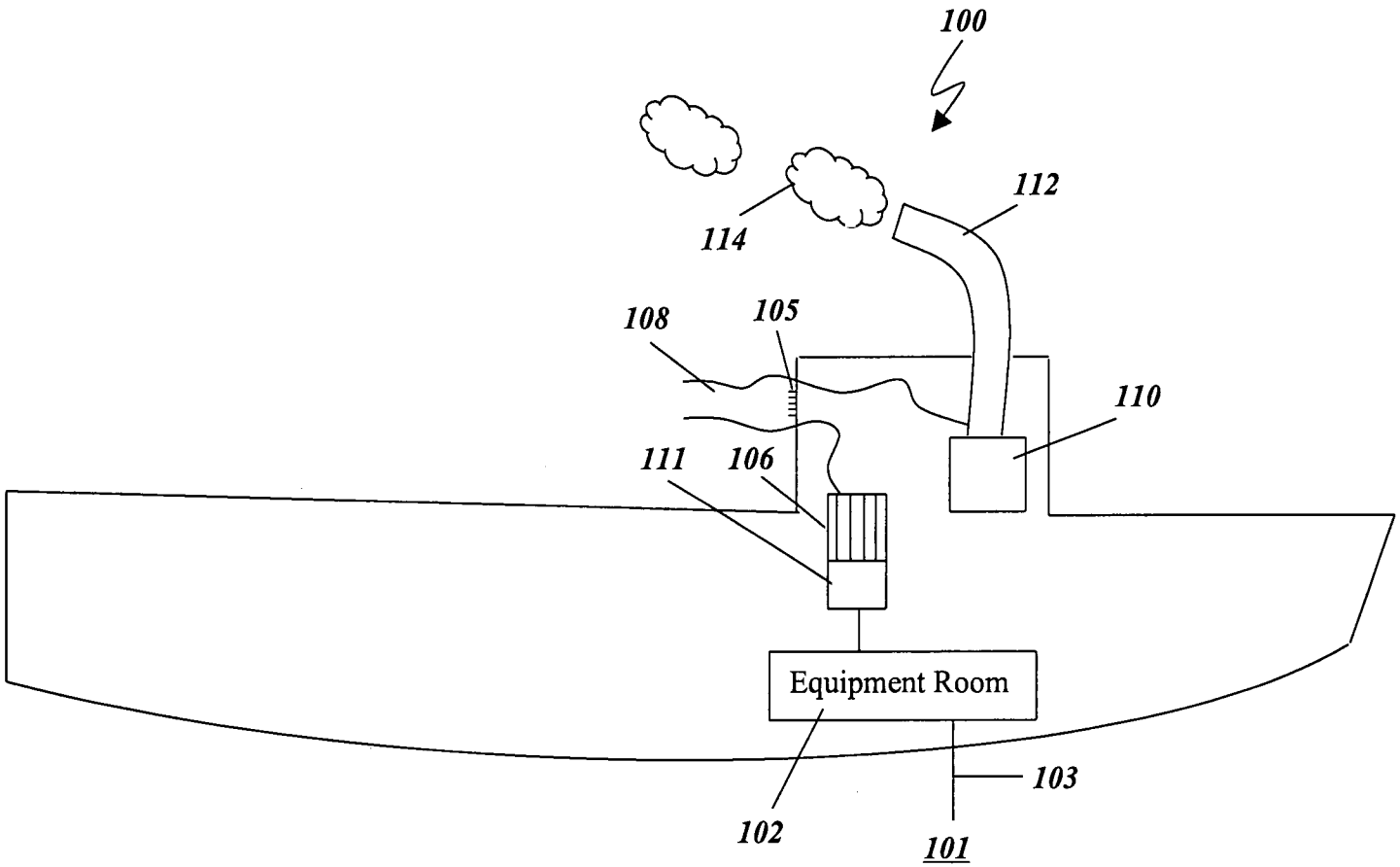
FIG. 1 depicts an illustrative embodiment of a system for cooling on a naval vessel.

In another illustrative embodiment, a system is disclosed for pumping water to a heat exchanger in an equipment operation station (EOS) during firefighting operations, the system including but not limited to, a fresh water pump in liquid communication with a fresh water reservoir, wherein the fresh water cooling system is in liquid communication with a first EOS heat exchanger in the EOS; a salt water pump in liquid communication with a salt water reservoir and the EOS heat exchanger; a valve in liquid communication with the fresh water reservoir, the fire water reservoir and the EOS heat exchanger; a fresh water flush tank having a volume larger than a volume for the EOS heat exchanger; and a valve controller configured to alternately connect the fire water reservoir to the salt water pump to supply salt water to the EOS heat exchanger during fire water pumping and connecting the EOS heat exchanger to the fresh water flush tank to flush salt water from the EOS heat exchanger after fire water pumping. In another particular embodiment of the system, the fresh water pump has a fresh water pumping capacity less than a salt water pumping capacity for the salt water pump. In another particular embodiment of the system, the fresh water pumping capacity is less than one half of the salt water pumping capacity. In another particular embodiment of the system, the fresh water pumping capacity is less than one tenth of the salt water pumping capacity.

In another particular embodiment, a method for pumping water on a naval vessel is disclosed, the method including but not limited to, pumping fresh water from a fresh water reservoir into an EOS heat exchanger in an EOS on a naval vessel; pumping salt water from a salt water reservoir into the EOS heat exchanger during fire operations; controlling a valve to alternately connect the EOS heat exchanger to the salt water reservoir to supply salt water to the EOS heat exchanger during fire operations and connecting the fire water reservoir to the fresh water flush to flush salt water from the EOS heat exchanger after fire water operations.

In another particular embodiment of the method, pumping fresh water into the EOS heat exchanger further includes but is not limited to connecting the EOS heat exchanger to a fresh water flush tank positioned between fire water reservoir and a fresh water pump. In another particular embodiment of the system, the fresh water flush tank has a volume smaller than a volume for the EOS heat exchanger. In another particular embodiment of the system, the fresh water pump has a fresh water pumping capacity less than a salt water pumping capacity for the salt water pump. In another particular embodiment of the system, the fresh water pumping capacity is less than one tenth of the salt water pumping capacity. In another particular embodiment of the system, the fresh water pumping capacity is less than one hundredth of the salt water pumping capacity.

Another illustrative embodiment provides a system and method for cooling an electrical device, such as motor exhaust air prior to discharging the air into a closed volume of air in a motor space, such as an equipment room on a naval vessel. The exhaust air cooling reduces the recycling of leakage water and particulate waste in the motor that in a closed loop intake air cooling system would blow waste particles such as carbon dust from rotor brushes and water leaking from the motor, directly back into the motor or other device being cooled, as would be the case for closed loop cooling system or a front cooled cooling system. In a particular illustrative embodiment, first and second electrical devices, such as a first and second motor and a first and second heat exchanger are enclosed in an equipment room, also referred to in the present disclosure as an equipment operation station (EOS). The EOS contains a closed volume of air in which the first and second motor and the first and second heat exchanger operate. In a particular illustrative embodiment, if a leak exists, the water does not enter into the motor. In another particular embodiment, an additional pressure drop in the system due to the change in pressure across the radiator or heat exchanger is compensated for by increasing the power rating of a cooling fan in the heat exchangers.

In another particular embodiment, additional desired cooling of the exhaust air is calculated once the exchanged volume of air in the space is given by the shipyard, the ambient temperature of the compartment is required and not to exceed American Bureau of Shipping (ABS) requirements and the desired total temperature of the motors is used, and again does not exceed ABS rules for propulsion machine limits.

In another particular embodiment, filtration of the exhaust carbon dust still occurs but due to less restrictions on the physical sizing of the radiator and also less cooling requirements due to having an "open loop" system, the fins and cooling coils of the heat exchanger are not so restricted therefore allowing larger grain size material to pass more easily. In another particular embodiment, the complexity and sealing is less problematic and does not exceed typical requirements of a standard 752 style blower/cooling system. In another particular embodiment, either salt water (raw water) or freshwater can be used as the cooling median in the heat exchangers.

In another particular embodiment, a conservative design in the "delta T" (change of temperature across the radiator) is provided so that even with one heat exchanger completely taken out of this system, sufficient cooling can be achieved for the system as a whole. In other words, with one heat exchanger not functioning, the system is designed such that the all electrical devices, including but not limited to electronics and motors in the EOS continue to operate at full capacity without overheating problems in any of the motor compartments.

In another particular embodiment, the cooling system and method provide an ABS rating of DP2, that is, with a single point of failure in the EOS, such a losing a single heat exchanger, the dynamic position motors in the EOS which operate to steer a naval vessel can still operate without over heating. In another particular embodiment, the system and method are simpler, have less moving parts, smaller, less complex and approximately ⅓ of the price of the conventional closed-loop cooler. This does not include the cost savings in plumbing, other heat exchanger devices, etc.

In another particular embodiment, a method is disclosed for cooling an electrical device, the method including but not limited to, supplying a first portion of a closed volume of air to a first electrical device; discharging the first portion of the closed volume of air from the first motor into a first heat exchanger; discharging the first portion of the closed volume of air from the first heat exchanger into the closed volume of air; supplying a second portion of the closed volume of air to a second motor; discharging the second portion of the closed volume of air from the second motor into a second heat exchanger; and discharging the second portion of the closed volume of air from the second heat exchanger into the closed volume of air. In another particular embodiment, the first heat exchanger has a cooling capacity greater than necessary to cool the first portion of the closed volume of air discharging from the first motor. In another particular embodiment, the second heat exchanger has a cooling capacity greater than necessary to cool the second portion of the closed volume of air discharging from the second motor.

In another particular embodiment, the first heat exchanger has a cooling capacity greater than necessary to cool the first portion of the closed volume of air discharging from the first electrical device, such as a motor and the second heat exchanger has a cooling capacity greater than necessary to cool the second portion of the closed volume of air discharging from the second electrical device, such as a motor. In another particular embodiment, the first heat exchanger has a cooling capacity sufficient to cool the first portion of the closed volume of air discharging from the first heat exchanger and the second portion of the closed volume of air discharging from the second heat exchanger. In another particular embodiment, the second heat exchanger has a cooling capacity sufficient to cool the first portion of the closed volume of air discharging from the first heat exchanger and the second portion of the closed volume of air discharging from the second heat exchanger.

In another particular embodiment of the method, the method further includes but is not limited to mixing with the closed volume of air, the first portion of the closed volume of air discharging from the first heat exchanger and the second portion of the closed volume of air discharging from the second heat exchanger. In another particular embodiment of the method, the method further includes cooling the closed volume of air with the first portion of the closed volume of air discharging from the first heat exchanger and the second portion of the closed volume of air discharging from the second heat exchanger. In another particular embodiment of the method, the method further includes but is not limited to cooling in the first heat exchanger, the first portion of the closed volume of air discharging from the first motor into the first heat exchanger. In another particular embodiment of the method, the method further includes but is not limited to cooling in the first heat exchanger, the closed volume of air including the second portion of the closed volume of air discharged from the second heat exchanger.

In another particular embodiment, a system is disclosed for cooling, the system including but not limited to a first air blower in pneumatic communication with a first portion of a closed volume of air and a first electrical device, such as a motor; a first heat exchanger in pneumatic communication with the first portion of the closed volume of air discharging from the first motor; a first air discharger in pneumatic communication with the first heat exchanger and the closed volume of air for discharging the first portion of the closed volume of air from the first heat exchanger into the closed volume of air; a second air blower in pneumatic communication with a second portion of the closed volume of air and a second electrical device, such as a second motor; a second heat exchanger in pneumatic communication with the second portion of the closed volume of air from the second motor into a second heat exchanger; and a second air discharger in pneumatic communication with the second heat exchanger and the closed volume of air for discharging the second portion of the closed volume of air from the second heat exchanger into the closed volume of air.

In another particular embodiment of the system, the first heat exchanger has a cooling capacity greater than necessary to cool the first portion of the closed volume of air discharging from the first motor. In another particular embodiment of the system, the second heat exchanger has a cooling capacity greater than necessary to cool the second portion of the closed volume of air discharging from the second motor. In another particular embodiment of the system, the first heat exchanger has a cooling capacity greater than necessary to cool the first portion of the closed volume of air discharging from the first motor and the second heat exchanger has a cooling capacity greater than necessary to cool the second portion of the closed volume of air discharging from the second motor.

In another particular embodiment of the system, the first heat exchanger has a cooling capacity sufficient to cool the first portion of the closed volume of air discharging from the first heat exchanger and the second portion of the closed volume of air discharging from the second heat exchanger. In another particular embodiment of the system, the second heat exchanger has a cooling capacity sufficient to cool the first portion of the closed volume of air discharging from the first heat exchanger and the second portion of the closed volume of air discharging from the second heat exchanger. In another particular embodiment of the system, the closed volume of air mixes the first portion of the closed volume of air discharging from the first heat exchanger and the second portion of the closed volume of air discharging from the second heat exchanger.

In another particular embodiment of the system, the closed volume of air is heated by the first portion of the closed volume of air discharging from the first heat exchanger and by second portion of the closed volume of air discharging from the second heat exchanger. In another particular embodiment of the system, the first heat exchanger cools the first portion of the closed volume of air discharging from the first motor into the first heat exchanger. In another particular embodiment of the system, the first heat exchanger cools the closed volume of air including the second portion of the closed volume of air discharged from the second heat exchanger. In another particular embodiment of the system, the closed volume of air is enclosed within an equipment room, also referred to as and equipment operation station. In another particular embodiment of the system, the closed volume of air is enclosed within an integral structure of a naval vessel.

Turning now to FIG. 1, in a particular illustrative embodiment, a naval vessel 100 floats in sea water 101. The vessel contains an equipment operation station 102 or EOS which is connected to EOS electronics 104 via electrical conductor 111. In another particular embodiment, the EOS is a sealed portion of the vessel structure where only electrical connecting are exposed to prevent damage to the electrical components inside of the EOS. The EOS electronics in a particular embodiment include but are not limited to a silicon controlled rectifier (SCR). In another particular illustrative embodiment, the EOS electronics are positioned adjacent and in thermal communication with heat sink 106. The heat sink is positioned in pneumatic communication with a stream of outside air 108 which is provided to supply air to an engine 110 on the naval vessel which may be a diesel or gasoline engine. The engine exhaust exits via vessel vent 112 which provide a conduit for vented air 114 from the engine.

Figure 2:
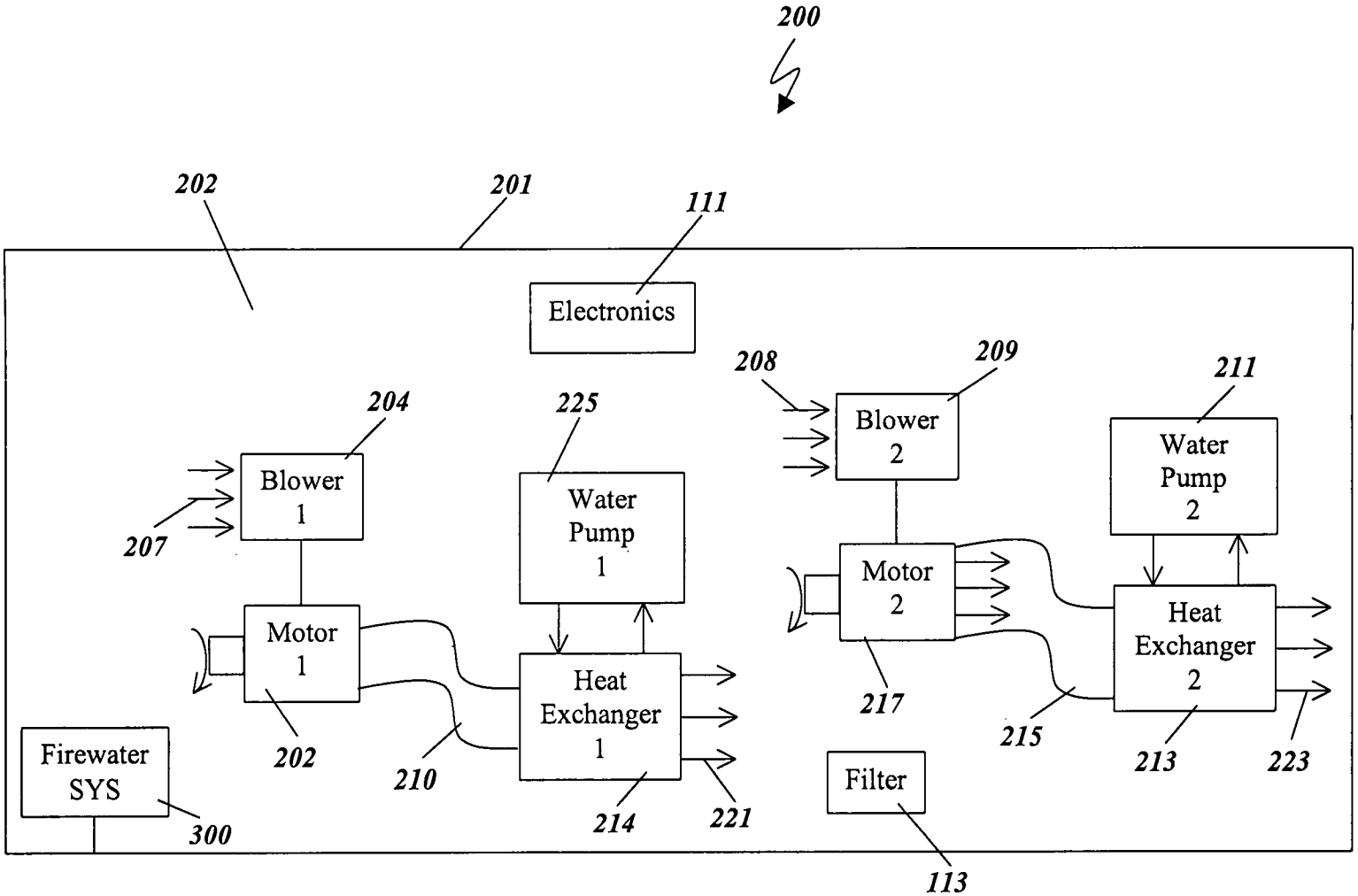
FIG. 2 depicts a particular illustrative embodiment of a cooling system for a closed volume of air containing motors.

Turning now to FIG. 2, a depiction of an illustrative embodiment of the equipment operating station (EOS) 200 is shown. The EOS walls 201 provide an enclosure for a closed volume of equipment room air 202. The EOS contains a first motor 202 and a first heat exchanger 219 which are in pneumatic communication. Heated exhaust air 210 from the first motor is fed to the first heat exchanger. The heated air is cooled by the heat exchanger and exhausts 221 into the EOS closed volume of air. Air 207 is supplied to the first motor from the EOS closed volume of air by blower 204.

In a particular embodiment, the first heat exchanger is equipped with a chiller such as water pump 225 for cool water heat exchange with the heated air entering the first heat exchanger. The EOS also includes but is not limited to a second motor 217 and a second heat exchanger 213 which are in pneumatic communication with each other. Heated exhaust air 215 from the second motor is fed to the second heat exchanger. The heated air from the second motor is cooled by the second heat exchanger and exhausts 223 into the EOS closed volume of air. Air 208 is supplied to the second motor from the EOS closed volume of air by blower 209. In a particular embodiment, the second heat exchanger is equipped with a chiller such as water pump 211 for cool water heat exchange with the heated air entering the first heat exchanger. In another particular embodiment the cooling system further includes but is not limited to a filter 113 for removing dirt and particulate waste particles from the closed volume of air. The first and second electrical devices or motors exhaust dirt, carbon dust from electric rotors and brushes and water from leaks when they occur, all of which are exhausted into the closed volume of air. The filter helps to remove the dirt, carbon dust from electric rotors and brushes and water from leaks from the closed volume of air.

Figure 3:
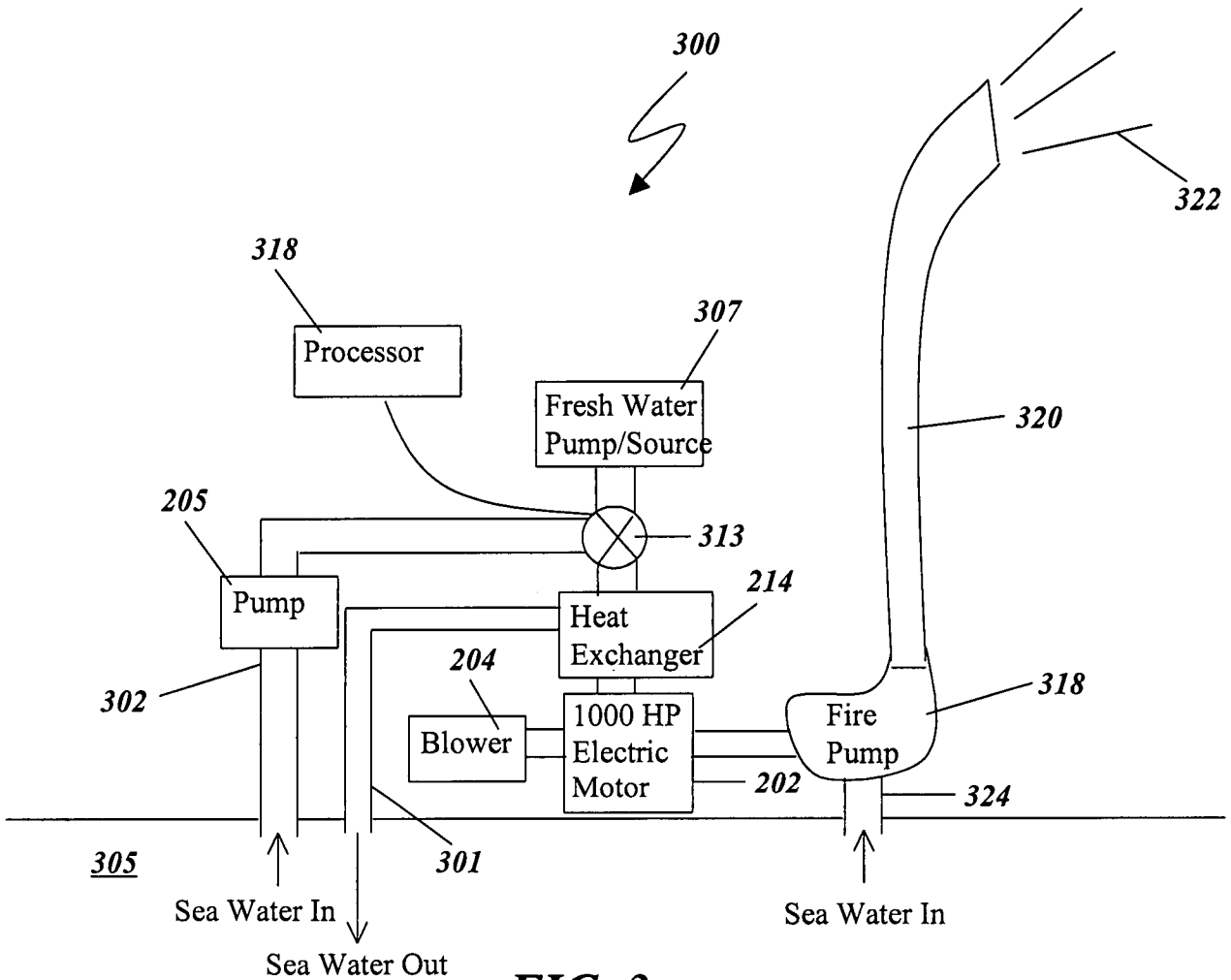
FIG. 3 depicts an illustrative embodiment of a firewater pumping system on a naval vessel.

In another particular embodiment, the EOS further contains a fire water system 300, as described in conjunction with FIG. 3. Turning now to FIG. 3, a depiction of a particular illustrative embodiment, a fire water system (FWS) 300 is shown. As shown in FIG. 3, the FWS includes but is not limited to a salt water source such as sea water 305 in fluid communication with pump 205 and valve 313. Valve 313 is also in fluid communication with fresh water pump/source 307. The fresh water pump is in fluid communication with fresh water source. The fresh water pump is a low pumping capacity pump which slowly pumps fresh water into the fresh water flush tank during the long periods between fire fighting operations. The valve 313 alternately provides fluid communication between the FWS heat exchanger 214 and either sea water 305 or fresh water 307. A valve controller 318 which in one illustrative embodiment includes but is not limited to a processor and computer readable medium containing instructions executed by the processor and memory for storing data in the computer readable medium. The valve controller is provided for controlling the position of the valve 313 to alternately provide fluid communication between the FWS heat exchanger 214 and either sea water 305 or fresh water 307. In another illustrative embodiment, the valve controller is a manual valve.

During fire operations, such as a fire or fire drill, which occur infrequently, the valve 313 is set by valve controller 318 to connect the heat exchanger 214 to sea water 305 via sea water pump 205. The sea water travels through sea water conduit 302 where the sea water is pumped by pump 205 through valve 313 to heat exchanger 214. The sea water pump has sufficient pumping power to supply sufficient sea water to a standard naval fire hose during fire fighting operations. In a particular embodiment the sea water pump 205 has pumping capacity of 100 gallons/minute. After fire fighting operations, valve 313 is positioned to provide fluid communication between the heat exchanger and the fresh water source/pump to rinse the corrosive sea water from the heat exchanger where it remains until the next fire fighting operation during which large volumes of sea water are pumped through heat exchanger 214. Heat exchanger 214 is used to chill air exhaust from motor 202 in the EOS. Blower 204 provides air to electric motor 202. Electric motor 202 power fire pump 318 which pump sea water from sea 305 through hose 320 where it is expelled as a sea water stream 322.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived there from, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A system for pumping water to a heat exchanger in an equipment operation station during firefighting operations, the system comprising:

a fresh water pump in liquid communication with a fresh water reservoir, wherein a fresh water cooling system is in liquid communication with a first equipment operation station heat exchanger in the equipment operation station;

a first sea water pump in liquid communication with a sea water reservoir and the equipment operation station heat exchanger;

a valve in liquid communication with the fresh water reservoir, a fire water reservoir and the equipment operation station heat exchanger;

a fresh water flush tank having a volume larger than a volume for the equipment operation station heat exchanger;

a valve controller configured to alternately connect the fire water reservoir to the sea water pump to supply sea water to the equipment operation station heat exchanger during fire water pumping and connecting the equipment operation station heat exchanger to the fresh water flush tank to flush sea water from the equipment operation station heat exchanger after fire water pumping wherein fresh water remains in the heat exchanger during the periods between fire fighting operations;

an electric motor in thermal communication with the heat exchanger, wherein the heat exchanger chills exhaust from the motor;

a blower in pneumatic communication with the motor, wherein the blower provides air to the electric motor; and a fire pump in fluid communication with the sea water source, wherein the fire pump is powered by the electric motor, wherein the fire pump pumps sea water from the sea water source to a fire hose during fire fighting operations.

2. The system of claim 1, wherein the fresh water pump has a fresh water pumping capacity less than a sea water pumping capacity for the sea water pump.

3. The system of claim 2, wherein the fresh water pumping capacity is less than one half of the sea water pumping capacity.

4. The system of claim 2, wherein the fresh water pumping capacity is less than one tenth of the sea water pumping capacity.

* * * * *